US005269036A

United States Patent [19]

Yan et al.

[11] Patent Number: 5,269,036

[45] Date of Patent: Dec. 14, 1993

[54] VEHICULAR RAMP APPARATUS

[76] Inventor: Alexander A. Yan; Richard Z. Yan, both of 111 Allen Dr., San Bruno, Calif. 94066

[21] Appl. No.: 999,276

[22] Filed: Dec. 31, 1992

[51] Int. Cl.[5] ..... E02C 3/00; B66F 19/00

[52] U.S. Cl. ..... 14/69.5; 254/88

[58] Field of Search ..... 14/69.5; 248/352; 254/88

[56] References Cited

U.S. PATENT DOCUMENTS

| | | | |
|---|---|---|---|
| 1,922,553 | 8/1933 | McCosh | 254/88 |
| 2,924,427 | 2/1960 | Larson | 254/88 |
| 3,178,156 | 4/1965 | Rigers | 254/88 |
| 3,606,253 | 9/1971 | Wooten et al. | 254/88 |
| 3,856,264 | 12/1974 | Thumma | 254/88 |
| 3,863,895 | 2/1975 | Grewe et al. | 14/69.5 X |
| 3,917,227 | 11/1975 | West | 248/352 X |
| 4,050,403 | 9/1977 | Miller | 254/88 |
| 4,993,685 | 2/1991 | Sparling | 254/88 |
| 5,001,798 | 3/1991 | Hamilton | 14/69.5 |
| 5,033,146 | 7/1991 | Fogarty et al. | 15/69.5 |

*Primary Examiner*—Ramon S. Britts
*Assistant Examiner*—James A. Lisehora
*Attorney, Agent, or Firm*—Leon Gilden

[57] ABSTRACT

A vehicular ramp includes a support plate having forward and rear abutment plates for positioning and arranged for latching on opposed sides of a vehicular wheel positioned upon the ramp structure.

4 Claims, 4 Drawing Sheets 42
43
44
22
21
23
24
25
26
27
28
26a
29
30
35
36
37

VEHICULAR RAMP APPARATUS

BACKGROUND OF THE INVENTION

1. Field of the Invention

The field of invention relates to vehicular ramp structure, and more particularly pertains to a new and improved vehicular ramp apparatus wherein the same is arranged to latch a vehicular wheel on the ramp structure.

2. Description of the Prior Art

Vehicular ramps of various types are utilized in the prior art and exemplified by U.S. Pat. Nos. 4,050,403; 3,917,227; 5,033,146; and 5,001,798.

The instant invention attempts to overcome deficiencies of the prior art by providing for a compact operative organization arranged to latch a vehicular wheel on the ramp structure and in this respect, the present invention substantially fulfills this need.

SUMMARY OF THE INVENTION

In view of the foregoing disadvantages inherent in the known types of vehicular ramp apparatus now present in the prior art, the present invention provides a vehicular ramp apparatus utilizing forward and rear abutment plates arranged for engaging and abutting opposed sides of a vehicular wheel upon the support ramp structure. As such, the general purpose of the present invention, which will be described subsequently in greater detail, is to provide a new and improved vehicular ramp apparatus which has all the advantages of the prior art vehicular ramp apparatus and none of the disadvantages.

To attain this, the present invention provides a vehicular ramp including a support plate having forward and rear abutment plates for positioning and arranged for latching on opposed sides of a vehicular wheel positioned upon the ramp structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vehicular ramp apparatus which has all the advantages of the prior art vehicular ramp apparatus and none of the disadvantages.

It is another object of the present invention to provide a new and improved vehicular ramp apparatus which may be easily and efficiently manufactured and marketed.

It is a further object of the present invention to provide a new and improved vehicular ramp apparatus which is of a durable and reliable construction.

An even further object of the present invention is to provide a new and improved vehicular ramp apparatus which is susceptible of a low cost of manufacture with regard to both materials and labor, and which accordingly is then susceptible of low prices of sale to the consuming public, thereby making such vehicular ramp apparatus economically available to the buying public.

Still yet another object of the present invention is to provide a new and improved vehicular ramp apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is an orthographic view, taken along the lines 10—10 of FIG. 9 in the direction indicated by the arrows.

DESCRIPTION OF THE PREFERRED EMBODIMENT

Figure 1:
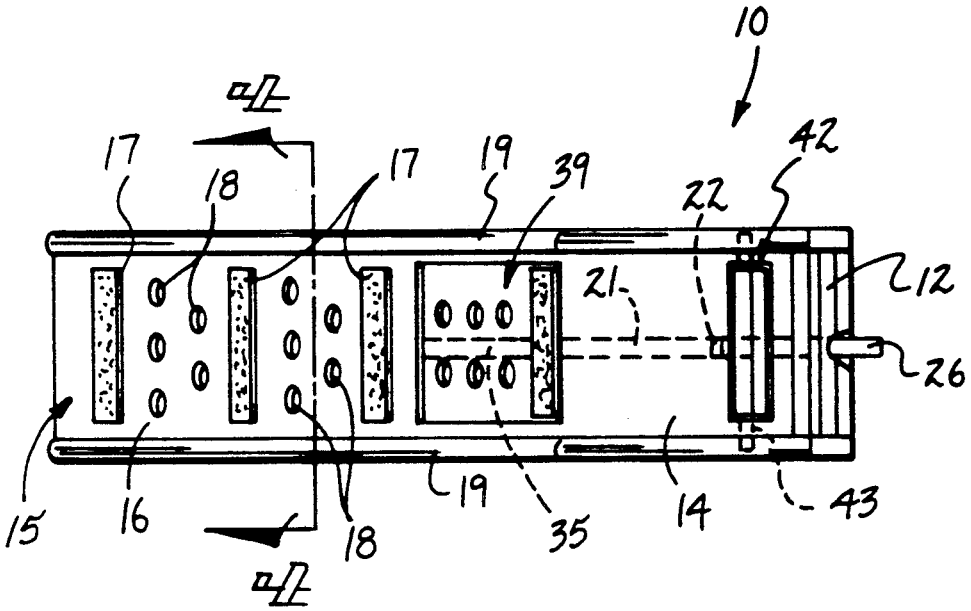
FIG. 1 is an orthographic top view of the invention.
Figure 2:
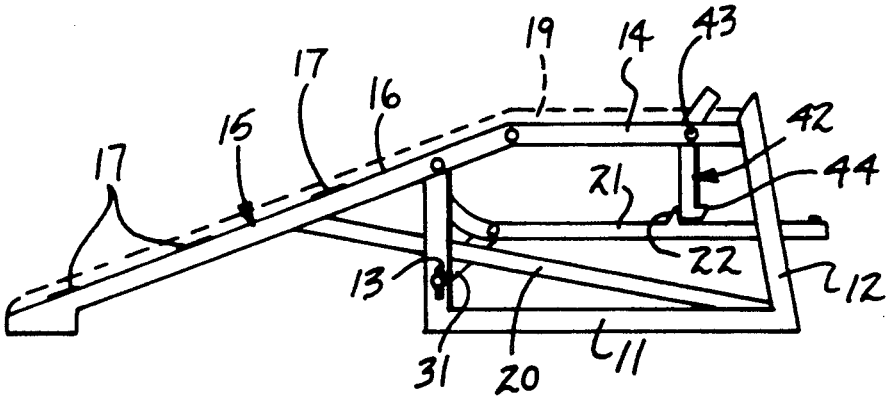
FIG. 2 is an orthographic side view of the invention.

With reference now to the drawings, and in particular to FIGS. 1 to 10 thereof, a new and improved vehicular ramp apparatus embodying the principles and concepts of the present invention and generally designated by the reference numeral 10 will be described.

More specifically, the vehicular ramp apparatus 10 of the instant invention essentially comprises a base plate 11 having a first end wall 12 spaced from a second end wall 13, with a vehicular support plate 14 positioned above the base plate, with the vehicular support plate 14 having a ramp plate 15 mounted to the vehicular support plate at an intersection and canted from the vehicular support plate 14 downwardly to a horizontal alignment with the base plate 11 and the ramp plate mounted at a first end to the intersection at a ramp plate second end to the horizontal alignment, with the base plate 11 spaced from the base plate and the second end wall 13. The ramp plate 15, as indicated in FIG. 1, includes a ramp plate top surface 16 having spaced side rails 19 in a parallel relationship along the ramp plate and extending along the support plate 14. A plurality of parallel friction strips 17 are mounted along the ramp plate top surface 16, as well as drain apertures 18 directed through the ramp plate 15. A support brace 20 extends from a further intersection of the first end wall 12 and the base plate to the ramp plate 15 for affording structural integrity to the organization.

Figure 3:
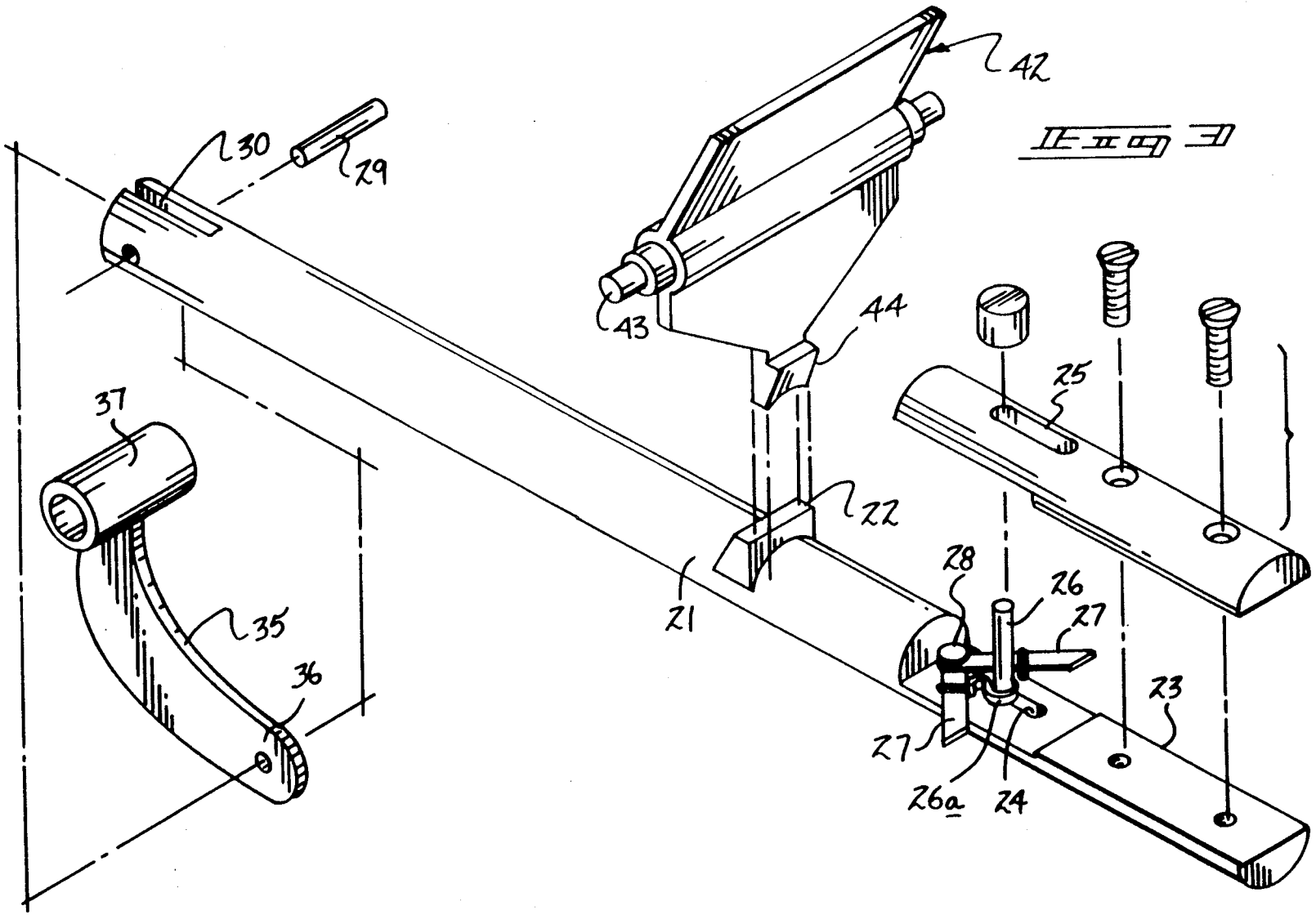
FIG. 3 is an isometric illustration of the actuator rod structure in an exploded view.
Figure 4:
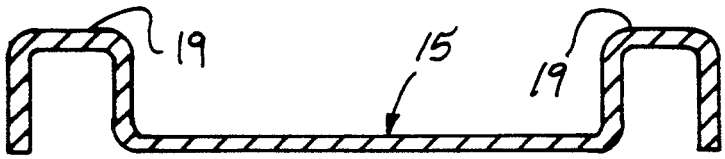
FIG. 4 is an orthographic view, taken along the lines 4—4 of FIG. 1 in the direction indicated by the arrows.
Figure 5:
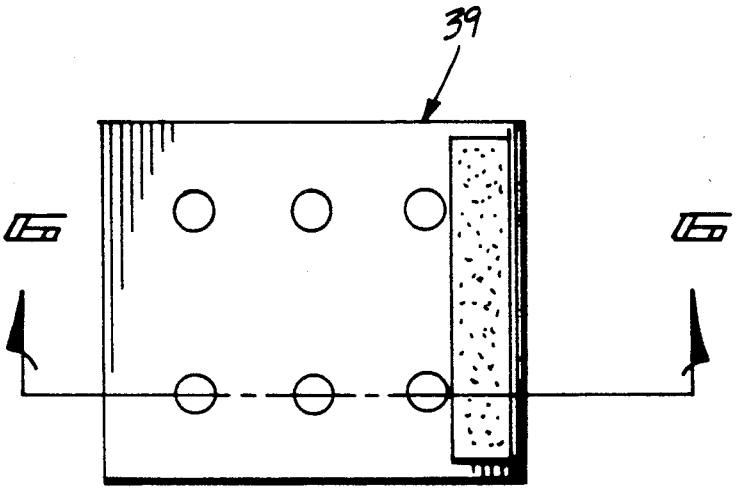
FIG. 5 is an orthographic top view of the forward abutment plate.
Figure 6:
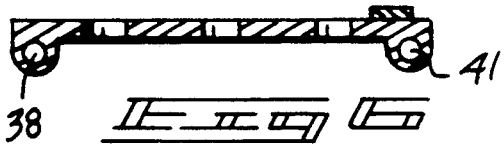
FIG. 6 is an orthographic view, taken along the lines 6—6 of FIG. 5 in the direction indicated by the arrows.
Figure 7:
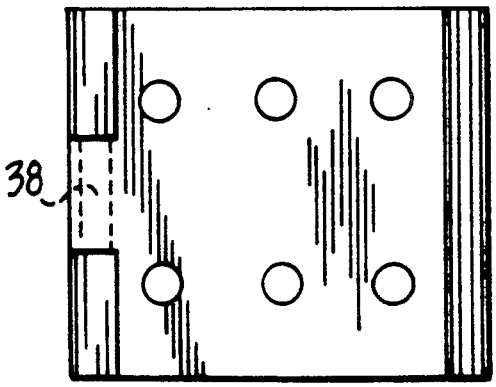
FIG. 7 is an orthographic bottom view of the forward abutment plate.
Figure 8:
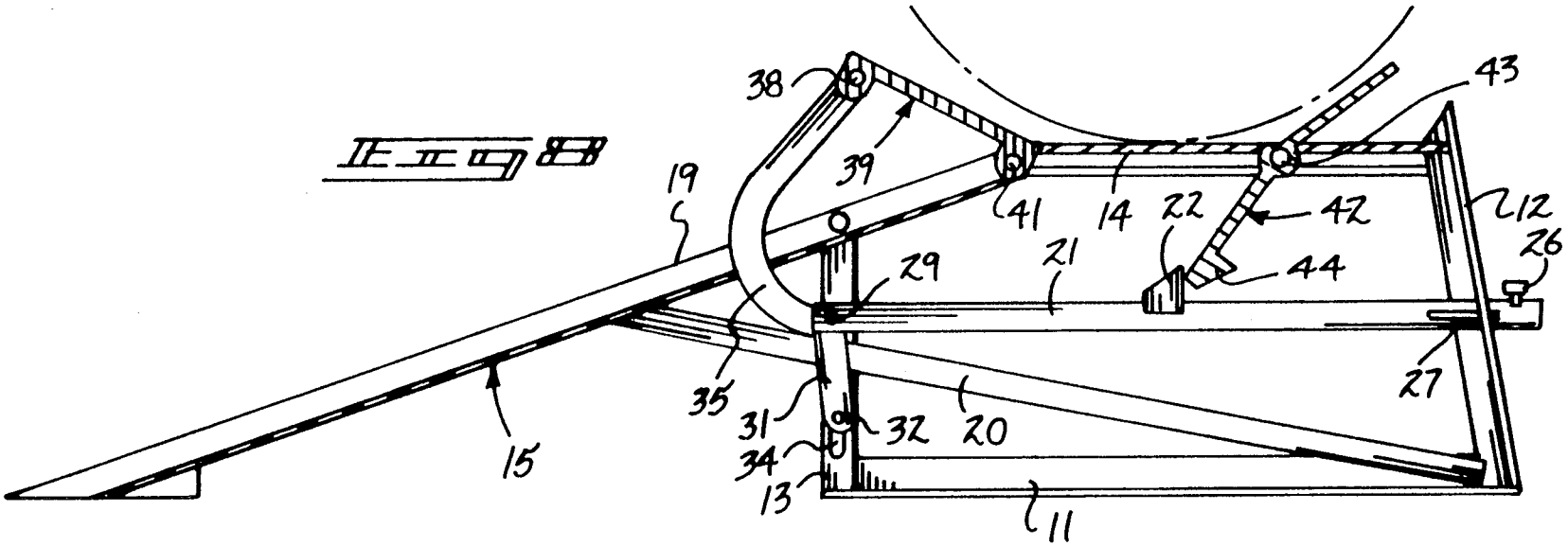
FIG. 8 is an orthographic cross-sectional illustration of the apparatus.
Figure 11:
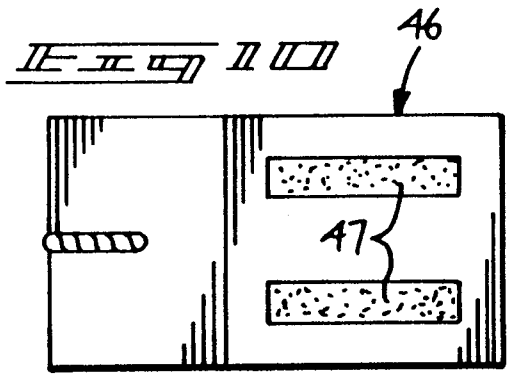
Figure 9:
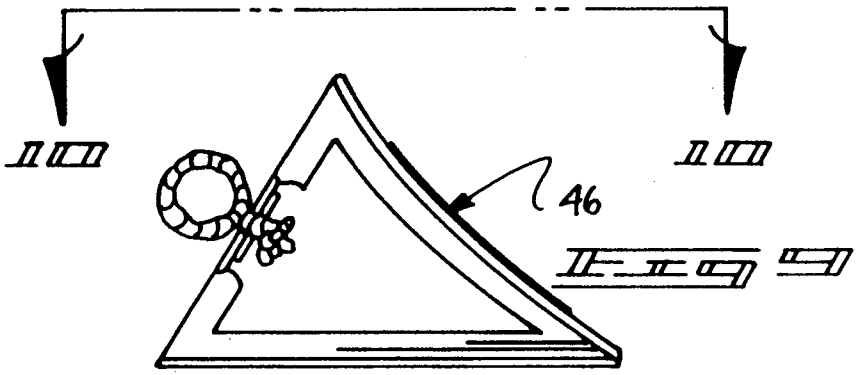
FIG. 9 is an orthographic side view of a rear wheel chock for use by the invention.

An actuator rod 21 is slidably directed through the first end wall 12 and includes an actuator rod abutment 22 projecting from the actuator rod 21 towards the support plate 14. An actuator rod first end portion 23 is arranged for slidable reception through a first end wall opening 12, in a manner as indicated in FIG. 1, with the actuator rod first end portion having first and second guide slots 24 and 25 that are arranged in coextensive alignment relative to one another of a split housing portion of the first end portion, wherein the split housing portion captures a plurality of lock plates 27 spring-biased for projection exteriorly of the first end portion in a biased orientation to project beyond the first end portion, with a lock rod 26 slidably received through the first and second guide slots 24 and 25, having a lock rod spring **26*a* in cooperative association between the lock rod and the lock plates 27, whereupon sliding of the lock rod 26 in a spaced relationship relative to and away from a lock plate pivotal axle 28 pivotally mounting the lock plates 27 effects biasing of the lock plates 27 towards the lock rod and within the actuator rod first end portion 23. Release of the lock rod 26 biased the lock rod 26 towards the lock plate pivotal axle 28 permitting projection of the lock plates, in a manner as indicated in FIG. 3. The actuator rod having an actuator rod second end includes an actuator rod second end pivot axle 29 directed therethrough and through an associated actuator rod slot 30. A guide link 31 is included (see FIG. 8 for example), with the guide link including a first end having a first end axle 32 slidably mounted within a guide link slot 34 through the second end wall 13, with the guide link second end pivotally mounted to the actuator rod second end pivot axle 29 within the actuator rod slot 30. An arcuate actuator link 35 is provided, having an actuator link first end 36 pivotally mounted to the actuator rod pivot axle 29 within the slot 30, and an actuator rod link second end 37 terminating in a tube to receive an actuator link axle 38 therethrough that in turn is pivotally mounted to a forward abutment plate 39, and more specifically, to the forward abutment plate first end. The forward abutment plate second end 40 includes a forward abutment plate axle 41 that in turn is mounted at the intersection of the support plate and the ramp plate 14 and 15 respectively, as indicated in FIG. 8**.

A rear abutment plate 42 is arranged for upward projection and latching upon projection of the actuator rod 21 towards the second end wall 13, whereupon the rear abutment plate 42 includes a rear abutment plate axle 43 medially of the rear abutment plate mounted rotatably to the support plate 14 parallel to the forward abutment plate axle 41 and the actuator link axle 38. A rear abutment plate first end lug 44 is arranged for engagement with the actuator rod abutment 22 to prevent the rear abutment plate 42 from pivoting relative to the actuator rod abutment 22.

Further, optionally employed are at least one of a plurality of wheel chocks 46 of cross-sectional configuration, having friction strips thereon and the friction strips 47, as indicated, are arranged for enhanced frictional engagement with a rear wheel structure of an associated vehicle.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A vehicular ramp apparatus, comprising, a base plate, the base plate including a first end wall mounted fixedly to the base plate spaced from a second end wall fixedly mounted to the base plate, and a support plate and a ramp plate, the support plate and the ramp plate integrally mounted together at an intersection, the support plate and the intersection positioned above the base plate, and the support plate and the ramp plate mounted to the first end wall respectively, and the second end wall, and the ramp plate having a ramp plate first end mounted to the intersection, and a ramp plate second end canted downwardly from the intersection arranged in horizontal alignment with the base plate spaced from the second end wall, and a forward abutment plate pivotally mounted to the intersection, and a rear abutment plate pivotally mounted to the support plate between the intersection and the first end wall, the rear abutment plate extending above the support plate and being adapted to be engaged by a vehicle tire, and an actuator member including means for cooperating with the rear abutment plate for causing projection of the forward and abutment plate above the support plate in response to engagement of the rear abutment plate by a vehicle tire.

2. An apparatus as set forth in claim 1 wherein the actuator member includes an actuator rod slidably directed through the first end wall, the actuator rod having an actuator rod first end portion, with the actuator rod first end portion arranged for sliding reception to the first end wall, and the first end portion having a split housing, with lock plates pivotally mounted within the split housing, and the split housing having a first guide slot and a second guide slot arranged in a coextensive relationship with a lock rod slidably directed through first and second guide slots, and the lock rod including a lock rod spring, and the lock rod spring arranged for engagement between the lock rod and the lock plates to bias the lock plates in a spaced relationship beyond the first end portion, and the means for cooperating with the rear abutment plate comprising an actuator rod abutment projecting from the actuator rod towards the support plate, and the rear abutment plate having a rear abutment plate axle mounted medially of the rear abutment plate pivotally mounted to the support plate, and the rear abutment plate further including a rear abutment plate first end lug positioned below the support plate in engagement with the actuator rod abutment.

3. An apparatus as set forth in claim 2 wherein the actuator rod includes an actuator rod second end having a second end slot, and a second end axle directed through the second end slot, and a guide link having a guide link first end, and a guide link slot directed through the second end wall, with the guide link having a guide link first end axle received within the guide link slot, and the guide link including a guide link second end pivotally mounted to the actuator rod second end axle, and an arcuate actuator link, having an actuator link first end pivotally mounted to the actuator rod second end axle, and the arcuate actuator link including an actuator link second end tube, with the second end tube having an actuator link axle directed through the second tube and pivotally mounted to the forward abutment plate.

4. An apparatus as set forth in claim 3 wherein the forward abutment plate includes a forward abutment plate axle pivotally mounted to the intersection parallel to the rear abutment plate axle and the actuator link axle.

* * * * *